US009574856B2

(12) United States Patent
Caillaut et al.

(10) Patent No.: US 9,574,856 B2
(45) Date of Patent: Feb. 21, 2017

(54) PYROTECHNIC GAS GENERATOR COMPONENT

(71) Applicant: NEXTER MUNITIONS, Versailles (FR)

(72) Inventors: Nicolas Caillaut, Sainte Solange (FR); Didier Cazajous, Argelès Gazost (FR)

(73) Assignee: NEXTER MUNITIONS, Versailles (FR)

( * ) Notice: Subject to any disclaimer, the term of this patent is extended or adjusted under 35 U.S.C. 154(b) by 0 days.

(21) Appl. No.: 14/647,217

(22) PCT Filed: Nov. 22, 2013

(86) PCT No.: PCT/FR2013/052826

§ 371 (c)(1),
(2) Date: May 26, 2015

(87) PCT Pub. No.: WO2014/080139

PCT Pub. Date: May 30, 2014

(65) Prior Publication Data

US 2015/0300789 A1 Oct. 22, 2015

(30) Foreign Application Priority Data

Nov. 23, 2012 (FR) ..... 12 03212

(51) Int. Cl.
*C06B 45/00* (2006.01)
*C06D 5/00* (2006.01)
(Continued)

(52) U.S. Cl.
CPC ..... *F42B 3/04* (2013.01); *C06B 45/14* (2013.01); *C06C 9/00* (2013.01); *C06D 5/06* (2013.01); *F42C 19/0815* (2013.01)

(58) Field of Classification Search
CPC ..... F42B 3/10; F42B 3/16
(Continued)

(56) References Cited

U.S. PATENT DOCUMENTS 2,195,965 A * 4/1940 Holm ..... F42B 3/04 102/531
2,777,389 A * 1/1957 Lawrence ..... F42B 3/103 102/202.14
(Continued)

FOREIGN PATENT DOCUMENTS

EP 2 336 710 A2 6/2011
FR 2 678 722 A1 1/1993
(Continued)

OTHER PUBLICATIONS

Feb. 28, 2014 International Search Report issued in International Application No. PCT/FR2013/052826.
(Continued)

*Primary Examiner* — Samir Abdosh
(74) *Attorney, Agent, or Firm* — Oliff PLC

(57) ABSTRACT

The invention relates to a pyrotechnic gas generator component including an inlet stage formed by a pyrotechnic detonator composition and an intermediate stage disposed between the inlet stage and an outlet stage formed by at least one gas generator composition, said intermediate stage being formed by a compressed black powder layer.

8 Claims, 2 Drawing Sheets

(51) Int. Cl.

| | |
|---|---|
| ***C06D 5/06*** | (2006.01) |
| ***C06B 45/12*** | (2006.01) |
| ***F42B 3/04*** | (2006.01) |
| ***C06B 45/14*** | (2006.01) |
| ***C06C 9/00*** | (2006.01) |
| ***F42C 19/08*** | (2006.01) |

(58) Field of Classification Search
USPC ..... 102/275.11, 277.1, 285
See application file for complete search history.

(56) References Cited

U.S. PATENT DOCUMENTS 3,055,300 A * 9/1962 Stoehr ..... F42B 4/12 102/339
3,344,742 A * 10/1967 Schneider, Jr. ..... F42B 23/16 102/394
3,722,421 A * 3/1973 Thrailkill ..... C06B 45/12 102/285
5,099,761 A * 3/1992 Betts ..... F42B 3/113 102/201
5,365,851 A * 11/1994 Shaw ..... F42D 1/04 102/275.11
5,465,795 A * 11/1995 Galbraith ..... A62C 35/023 169/11
6,352,029 B1 3/2002 Guirguis et al.
2003/0150348 A1* 8/2003 Furusawa ..... B60R 21/2644 102/202.9
2005/0039623 A1* 2/2005 Furusawa ..... F42B 3/127 102/202.7
2012/0240806 A1 9/2012 Gonsalves et al.

FOREIGN PATENT DOCUMENTS

GB 2461976 A 1/2010
WO 99/53263 A2 10/1999
WO 01/94277 A2 12/2001

OTHER PUBLICATIONS

Feb. 28, 2014 Written Opinion issued in International Application No. PCT/FR2013/052826.

* cited by examiner

PYROTECHNIC GAS GENERATOR COMPONENT

The technical field of the invention is that of pyrotechnic components, and particularly gas generator components.

It is conventional to make pyrotechnic gas generators, particularly in the field of automotive security systems.

The known generators most often use one or more gas generator compositions, for example a redox composition such as the one described in patent FR2871457, or a propellant powder.

These compositions are conventionally initiated using a flame generator component (pyrotechnic squib).

However, it can be difficult to integrate a squib, for example within an ammunition already equipped with an armament device having a detonation output.

Indeed, the replacement of a detonator by a squib imposes to entirely redefine the pyrotechnic priming system. However, there is a need for integrating a gas generator component, for example for defining an ammunition variant, the variant having a function different from that of the base ammunition which is explosive.

This function could be a function for dispersing or ejecting a payload for example, for this function it is necessary to provide a gas generator instead of a detonation relay.

Furthermore, in certain ammunition applications, it is necessary that the gas generation be performed extremely quickly, for example for an ammunition for dispersing sub-projectiles over a trajectory, ammunition for which the precision of the dispersion time is very important. The invention is thus intended to define a gas generator component, the operating time of which is shorter than that of generators operated by a pyrotechnic squib.

Patent GB2461976 describes a detonator allowing to ensure an initiation of explosives with a low detonation speed from an explosive wick with a high detonation speed. This detonator comprises a case enclosing several layers of mixture of explosive with a high detonation speed and of explosive with a low detonation speed (for example, the black powder). The most downstream layer can be a propellant powder or used to ignite a propellant powder. The most upstream layer is the one having the highest explosive rate. It is initiated by a detonator. The disadvantage of this component is that it requires a great number of layers to ensure dumping of the detonation wave. It is thus particularly cumbersome.

Thus, the invention relates to a pyrotechnic gas generator component comprising at least one gas generator composition, the component being characterized in that it comprises an inlet stage formed by a pyrotechnic detonator composition, and an intermediate stage disposed between the inlet stage and the outlet stage formed by the gas generator composition(s), the intermediate stage being formed by at least one layer of compressed black powder.

According to an embodiment, the different stages are arranged in a cup comprising a truncated-cone shape portion receiving all or part of the intermediate stage, the small diameter of the truncated-cone shape portion being in communication with a first housing receiving the detonator composition.

According to another embodiment, the different stages are arranged in a cup comprising a cylindrical bore receiving the inlet stage, the intermediate stage and the outlet stage.

In all cases, the inlet stage could comprise 30 to 60 milligrams of hexogen and the intermediate stage could enclose black powder having a grain size between 0.1 and 0.6 mm and compressed under between 30 and 70 MPa.

The outlet stage could comprise a layer of between 150 and 300 milligrams of propellant powder.

The cup could advantageously comprise a thin wall integrally formed with the cup and ensuring the sealing thereof upstream from the inlet stage.

The invention will become more apparent when reading the following description of an embodiment, the description being made with reference to the appended drawings in which.

Figure 1:
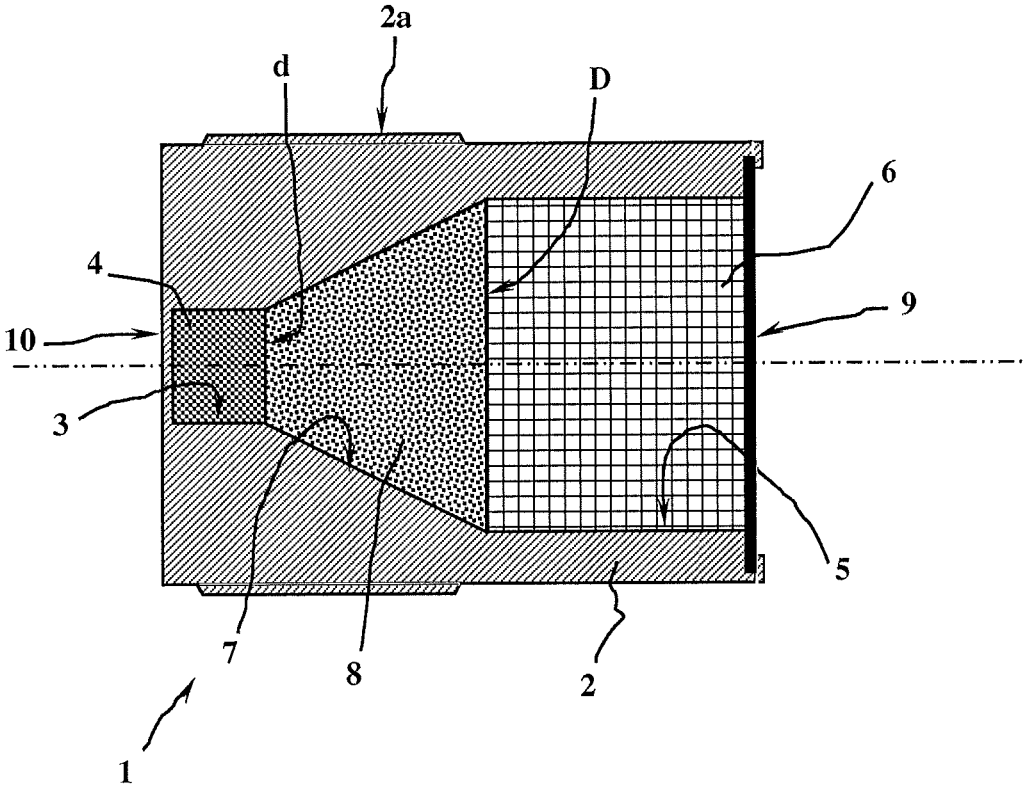
FIG. 1 shows a longitudinal cross-sectional view of a component according to a first embodiment of the invention.

With reference to FIG. 1, a pyrotechnic gas generator component 1 according to the invention comprises a metal cup 2 delimiting two cylindrical housings 3 and 5. The cup 2 comprises an external screw thread 2*a* allowing the attachment thereof within an ammunition (not shown).

A first cylindrical housing 3 encloses a pyrotechnic detonator composition 4 constituting an inlet stage of the component 1. A second cylindrical housing 5 encloses a gas generator composition 6 constituting an outlet stage of the component 1.

The cup 2 comprises a truncated-cone shape portion 7 mainly receiving an intermediate stage 8 constituted by a compressed black powder layer. "Mainly" means that the major part of the intermediate stage 8 is located in the truncated-cone shape portion 7 and that the volume of this latter is mostly occupied by the intermediate stage 8.

About 90% of the volume of the truncated-cone shape portion 7 will thus be occupied by the intermediate stage 8. Indeed, it is difficult to industrially perform a loading of the different stages 4, 8 and 6 that is strictly limited to a well-defined portion.

Thus, the inlet stage 4 of the first housing 3 could slightly extend into the truncated-cone shape portion 7 and the intermediate stage 8 could slightly extend into the second housing 5.

The small diameter d of the truncated-cone shape portion 7 is in communication with the first housing 3 receiving the detonator composition 4. The diameter of the first cylindrical housing 3 is thus equal to the small diameter d of the truncated-cone shape portion 7.

The large diameter D of the truncated-cone shape portion 7 is in communication with the second housing 5. The diameter of the second cylindrical housing 5 is thus equal to the large diameter D of the truncated-cone shape portion 7.

The cup 2 is sealed at its outlet stage 6 by a crimped metal mat 9.

The cup 2 comprises a thin wall 10 at its inlet stage 4. The thin wall 10 is integrally formed with the cup 2 and ensures the tightness of the component upstream therefrom. This wall closes the cup 2 and allows to successively compress the different composition layers directly in the cup. The manufacturing is thus simplified.

According to a particular embodiment, an inlet stage 4 comprising 30 to 60 milligrams of hexogen could be made. This inlet stage 4 thus comprises a detonator composition. This composition can be easily initiated by the shock wave provided by a detonator (not shown) of a pyrotechnic ammunition chain (not shown). The shock wave could initiate the inlet stage 4 directly through the wall 10 the thickness of which is about 0.3 mm.

According to the embodiment shown, the outlet stage 6 comprises a layer of between 150 and 300 milligrams of propellant powder, for example a simple base spherical powder.

The outlet stage could also be composed of a redox composition such as a composition associating potassium perchlorate (oxidizing agent) and tartaric, citric or myristic acid (reducing agent), or a composition associating boron (reducing agent) and potassium nitrate (oxidizing agent).

The component thus receives as input a pyrotechnic phenomenon which is a detonation (the speed of the detonation wave being of several thousands meters per second).

However, the outlet stage 6 of the component provides a gas, and the combustion speed in the outlet stage 6 is a few hundreds meters per second.

For the detonation coming from the inlet stage 4 not to destroy the outlet stage 6, it is necessary to define an intermediate stage 8 which transforms the detonation wave into an ignition signal.

This function is ensured by a black powder load 8 having a fine grain size (for example, a PN7, that is the conventional name for a black powder the grain size of which is between 0.2 and 0.5 mm) which is compressed under between 30 and 70 Megapascals.

The compression rate allows to ensure the mechanical strength of the black powder during the gun shot. The compression rate also allows to ensure the detonation/combustion transition. Indeed, it has been possible to confirm that a non-compressed black powder with such grain size adopts a deflagrant behavior, which is too strong and does not allow to initiate the combustion of the outlet stage 6.

The compression of the intermediate stage allows the detonation power from the inlet stage to be gradually damped. This energy changes into thermal energy igniting the black powder which ensures the ignition of the outlet stage 6.

Thus, different component tests have been performed, in which the black powder of the PN7 type was compressed or non-compressed. The inlet stage 4 (detonator composition) being always the same, it has been possible to confirm that, with a non-compressed black powder (bulk powder), the component output was a deflagration and could not ignite the outlet stage 6. However, for compression rates of the black powder varying from 30 to 70 MPa, the component output is an ignition signal. A compression rate of the black powder higher than 70 MPa will make the priming of this latter more difficult, which will limit its operational interest.

The grain size will be chosen between 0.1 and 0.6 mm, because this value interval contributes to the damping of the detonation wave. Indeed, it was found that a powder having a higher grain size deflagrates (the speed of progression of the reaction being higher than a few hundreds of meters per second), which is too strong for a suitable combustion behavior.

The truncated-cone shape profile of the intermediate stage 7 allows to facilitate the loading of compressed black powder and ensures a regular progression of the reaction wave fronts between the different layers, considering the diameter difference between the inlet stage and the outlet stage.

Of course, it is necessary to adapt the mass of the detonator composition of the inlet stage 4 to the mass of the black powder of the intermediate stage 8 and to the length of this stage.

With an intermediate stage 8 of 300 milligrams of black powder PN7, an inlet stage 4 comprising an explosive mass of less than 50 milligrams will be provided.

Such component according to the invention has an operating time of 2.5 milliseconds. This operating time corresponds to the interval separating the inlet stage initiating time from the time at which the effect caused by the outlet stage occurs (for example, ejection of sub-projectiles). For comparison purposes, a gas generator having the same mass of gas generator composition, but initiated by a conventional squib, has an operating time of about 10 milliseconds.

Figure 2:
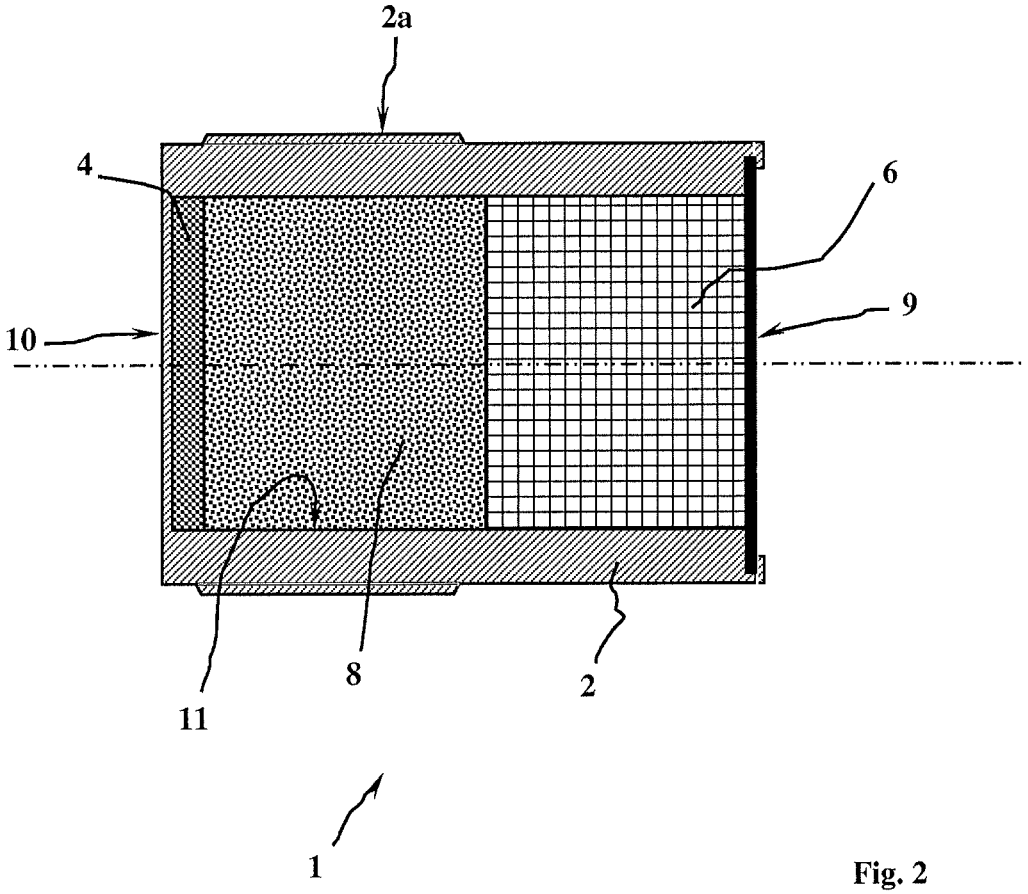
FIG. 2 shows a longitudinal cross-sectional view of a component according to a second embodiment of the invention.

FIG. 2 shows a second embodiment of the invention, which differs from the preceding one in that the cup 2 comprises a cylindrical bore 11 receiving the inlet stage 4, the intermediate stage 8 and the outlet stage 6.

Each layer of the component 1 thus has the same diameter. The inlet stage 4 is here again constituted by a pyrotechnic detonator composition, the intermediate stage 8 is constituted by compressed black powder, and the outlet stage 6 is constituted by a gas generator composition. With this embodiment, the inlet stage has a larger diameter, which leads to a detonation front also having a larger diameter, thus closer to a plane wave. However, with this embodiment, it is necessary to provide an intermediate stage with a greater length to ensurer damping of the detonation. This embodiment is thus more cumbersome than the preceding one.

The invention claimed is:

1. A pyrotechnic gas generator component comprising at least one gas generator composition, wherein the component comprises an inlet stage constituted by a pyrotechnic detonator composition, and an intermediate stage disposed between the inlet stage and the outlet stage formed by the gas generator composition(s), the intermediate stage being formed by at least one layer of compressed black powder, and wherein the different stages are arranged in a cup comprising a truncated-cone shape portion receiving all or part of the intermediate stage, the small diameter of the truncated-cone shape portion being in communication with a first housing receiving the detonator composition.

2. The gas generator component according to claim 1, wherein the inlet stage comprises 30 to 60 milligrams of hexogen, the intermediate stage enclosing black powder having a grain size between 0.1 and 0.6 mm and compressed under between 30 and 70 MPa.

3. The gas generator component according to claim 1, wherein the outlet stage comprises a layer of between 150 and 300 milligrams of propellant powder.

4. The gas generator component according to claim 1, wherein a cup comprises a thin wall integrally formed with the cup and ensuring the sealing thereof upstream from the inlet stage.

5. A pyrotechnic gas generator component comprising at least one gas generator composition, wherein the component comprises an inlet stage constituted by a pyrotechnic detonator composition, and an intermediate stage disposed between the inlet stage and the outlet stage formed by the gas generator composition, the intermediate stage being formed by at least one layer of compressed black powder, and wherein the different stages are arranged in a cup comprising a cylindrical bore receiving the inlet stage, the intermediate stage and the outlet stage.

6. The gas generator component according to claim 5, wherein the inlet stage comprises 30 to 60 milligrams of hexogen, the intermediate stage enclosing black powder having a grain size between 0.1 and 0.6 mm and compressed under between 30 and 70 MPa.

7. The gas generator component according to claim 5, wherein the outlet stage comprises a layer of between 150 and 300 milligrams of propellant powder.

8. The gas generator component according to claim 5, wherein a cup comprises a thin wall integrally formed with the cup and ensuring the sealing thereof upstream from the inlet stage.

* * * * *